United States Patent [19]

Yoshikawa et al.

[11] Patent Number: 4,831,408

[45] Date of Patent: May 16, 1989

[54] ELECTROPHOTOGRAPHIC APPARATUS CAPABLE OF FORMING IMAGES IN DIFFERENT COLORS

[75] Inventors: Masao Yoshikawa, Tokyo; Tatsuya Kobayashi, Yokohama; Takashi Saito, Ichikawa, all of Japan

[73] Assignee: Canon Kabushiki Kaisha, Tokyo, Japan

[21] Appl. No.: 82,519

[22] Filed: Aug. 7, 1987

[30] Foreign Application Priority Data

Aug. 8, 1986 [JP] Japan ..... 61-185312
Aug. 8, 1986 [JP] Japan ..... 61-185313

[51] Int. Cl.[4] ..... G03G 15/00; G03G 15/01; G03G 13/01

[52] U.S. Cl. ..... 346/157; 118/645; 430/42; 346/160

[58] Field of Search ..... 355/4, 3 DD, 14 D; 430/120, 42; 346/157; 118/645, 653, 656–658

[56] References Cited

U.S. PATENT DOCUMENTS 4,599,285 7/1986 Haneda et al. ..... 355/4

FOREIGN PATENT DOCUMENTS 55788 1/1980 Japan ..... 355/4
87060 7/1981 Japan ..... 355/4
178745 5/1983 Japan ..... 355/4
150974 9/1983 Japan ..... 355/4
203474 9/1986 Japan ..... 355/4

*Primary Examiner*—A. C. Prescott
*Assistant Examiner*—Edward Pipala
*Attorney, Agent, or Firm*—Fitzpatrick Cella, Harper & Scinto

[57] ABSTRACT

An electrophotographic apparatus includes a movable electrophotographic photosensitive member, a charger for uniformly charging the photosensitive member, a first device for forming a first electrostatic latent image by exposing the photosensitive member charged by the charger to negative image light corresponding to first image information, a first developing device for developing through a reversal development the first electrostatic latent image into a first visualized image, a second device for exposing the photosensitive member having the first visualized image to positive image light corresponding to second image information to form a second electrostatic latent image, a second developing device for developing through a regular development the second electrostatic latent image into a second visualized image, wherein a potential level in an area of the photosensitive member exposed to the light by the second device is between a potential level in an area of the photosensitive member exposed to the light by the first electrostatic latent image forming device and a potential level in a non-exposed area of the photosensitive member, and is between a potential level of the first visualized image and the level of non-exposed area.

14 Claims, 2 Drawing Sheets

ELECTROPHOTOGRAPHIC APPARATUS CAPABLE OF FORMING IMAGES IN DIFFERENT COLORS

FIELD OF THE INVENTION AND RELATED ART

The present invention relates to an electrophotographic apparatus, more particularly to a two color image forming electrophotographic apparatus wherein an electrostatic latent image bearing member is uniformly charged electrically and is exposed to first image light so that a first electrostatic latent image is formed, and is then developed into a first toner image; and the electrostatic latent image bearing member is exposed to second light image so that a second electrostatic latent image is formed, and is developed with a second toner, which is different in color from the first toner, into a second toner image, whereby a two color image or print is formed through one image forming cycle.

As for terminal printers usable with computer, facsimile machine, CAD or other information machines, electrostatic recording type printers using an electrophotographic process are widely used.

In such printers, information signals in the form of light provided by laser beam source, LED (light emitting diode), LCD (liquid crystal device) or the like are applied onto a photosensitive member functioning as an electrostatic latent image bearing member so as to form a latent image corresponding to the information, and then the latent image is developed by a developing device; thereafter, the developed image is transferred onto and fixed on a transfer material, so that a recorded print is provided. In the conventional printer, the provided print is in only one color, i.e. black.

Recently, however, there is a demand for a print made in at least two colors since then the printed information is easy to understand, as in the case that data are printed in a color different from that of a format or in the case that a part of a figure outputted by CAD is in different color. There are various proposals for the two color recording. Some of typical systems will be described.

A first example is disclosed in Japanese Laid-Open Patent Application No. 52760/1981. A uniformly charged photosensitive member is exposed to negative image light (first exposure) to provide a first electrostatic latent image (negative latent image), which is developed through a reversal development by a first developing device into a first toner image; and then the photosensitive member is exposed to another negative image light (second exposure) to form a second electrostatic latent image (negative latent image), which is developed through a reversal development by a second developing device into a second toner image.

This method involves a problem that the colors are mixed because after the first toner image formation, the first negative latent image remains, so that the first latent image is also more or less developed with the second color developer during the second developing operation for developing the second negative latent image.

A second method is disclosed in Japanese Laid-Open Patent Application Publications Nos. 137538/1980 or 2047/1982. A uniformly charged photosensitive member is exposed to a negative image light (first exposure) to form a negative latent image, which is then developed through a reversal development by a first developing device into a first toner image; and the photosensitive member is exposed to a positive image light (second exposure) to form a positive latent image, which is developed through a regular development by a second developing device into a second toner image. According to this method, the first and second images are developed with two kinds of toner particles which are electrically charged to opposite polarities, through a reversal development and a regular development, respectively, and therefore the colors are not easily mixed, which is, of course, advantageous. Additionally, inventors' experiments have revealed that this method is further advantageous in that the electrostatic contrast of the latent image at the time of each developing operations can be made higher so that a sufficient image density of the toner image can be provided without background fog; and in that an area of the photosensitive member in which E-V properties (latent image potential VS exposure amount) is stabilized is used as background so that it is easy to stabilize the potential of the background area.

However, it has been found by the inventors that this method involves a problem. When the second exposure is effected (positive image exposure), the charge in the periphery of the first toner image attenuates to such an extent that the latent image potential of the first toner image becomes substantially the same as the latent image potential therearound or becomes lower than the toner image potential so that an electrostatic potential "wall" by the negative latent image effective to retain the toner image is disturbed or removed. Therefore, the toner particles constituting the first toner image are easily released from the first image portion and are scattered around, with the result of unsharp images.

As another system, Japanese Laid-Open Patent Application No. 87060/1981 discloses that negative and positive latent images are formed in three levels of latent image potential. In this system, the intermediate level of the three levels is substantially at the center between the low and high levels, and therefore, the latent image contrast of each of the images is relatively low, with the result that the image density is not high enough. In an attempt to obtain high contrast, it is considered that the photosensitive member is charged to a high potential. However, if this were done, the photosensitive member would be damaged more rapidly.

Therefore, there exist a need for a two color image forming apparatus which can provide sharp and bright color images.

SUMMARY OF THE INVENTION

Accordingly, it is a principal object of the present invention to provide an electrophotographic apparatus which can produce clear and bright color images with a high image density and without a foggy background.

It is another object of the present invention to provide an electrophotographic apparatus wherein the toner particles are not scattered from a line image or edge portions of an image, so that a sharp image can be provided.

It is a further object of the present invention to provide an electrophotographic apparatus wherein it is used with a particular developing apparatus, so that a good image quality of the developed image can be provided.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
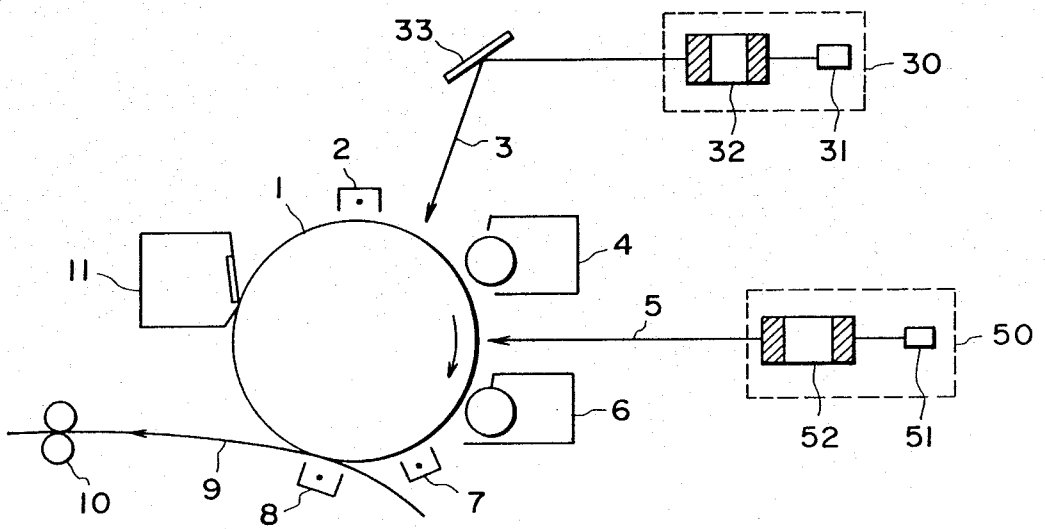
FIG. 1 is a somewhat schematic sectional view of an electrophotographic apparatus according to an embodiment of the present invention

Referring to FIG. 1, there is illustrated an electrophotographic apparatus according to an embodiment of the present invention.

The apparatus includes an electrostatic latent image bearing member 1 in the form of an electrophotographic photosensitive drum having a conductive base and a photoconductive layer of OPC (organic photoconductor), amorphous silicon or the like thereon. The photosensitive drum is rotatable in the direction indicated by an arrow. The photosensitive drum is uniformly charged by a charger 2 and is exposed to light signals representing first image information and provided by a laser beam 3, for example, so that a first electrostatic latent image is formed. The first electrostatic latent image is visualized by a first developing device 4. Subsequently, the photosensitive drum is exposed to light signals representing second image information and provided by a laser beam 5, for example, so that a second electrostatic latent image is formed on the photosensitive drum 1. The second latent image is developed by a second developing device 6 with a toner having a color different from that of the first developing device. The first and second visualized images on the photosensitive drum 1 are charged to a predetermined polarity by a post-charger 7, and then is transferred onto a transfer charger 8 onto a transfer material 9. The transfer material 9 is further conveyed to an image fixing device 10, where the first and second visualized images are fixed, so that a two color print is produced.

After the image transfer, the toner remaining on the photosensitive drum 1 is removed by a cleaning device 11.

The laser beam is provided by a first laser beam scanner unit 30 and a second laser beam scanner unit 50. The first laser beam scanner unit 30 includes a semiconductor laser source 31 and a deflecting means 32 having a polygonal mirror or the like for deflecting the laser beam 3 emitted from the laser beam source 31. Similarly, the second laser beam scanner unit 50 includes a semiconductor laser source 51 and a deflecting means 32 having a polygonal mirror or the like for deflecting the laser beam 5 emitted from the laser source 51. A reflecting mirror 33 is provided for directing the laser beam to the photosensitive drum.

The image forming process using the above described electrophotographic apparatus will be further described in conjunction with FIGS. 2A, 2B, 2C, 2D and 2E.

Figures 2A, 2B, 2C, 2D, 2E:
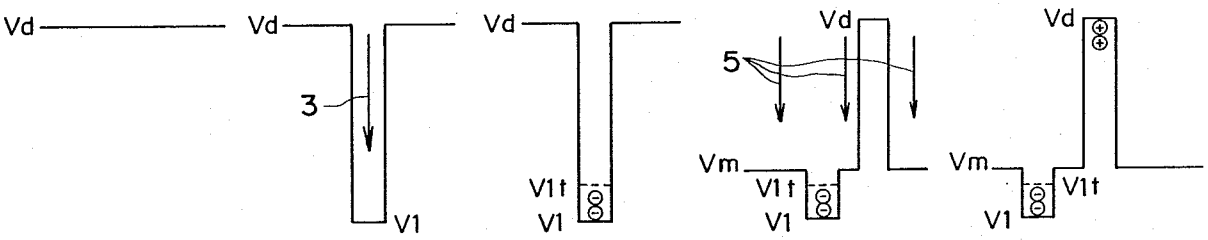
FIGS. 2A, 2B, 2C, 2D and 2E are graphs illustrating potential changes in an image forming process in the apparatus of FIG. 1.

The photosensitive drum 1 is charged by a primary charger 2 to a uniform negative potential Vd (FIG. 2A). The photosensitive drum 1 is then exposed to a scanning laser beam 3 which is modulated in accordance with the first image information. The intensity of the laser beam 3 is so selected that the potential in the exposed area attenuates substantially down to a residual potential level of the photosensitive member. In this image exposure, the laser beam 3 for the first image exposure provides a negative image by which the charge in the image area is attenuated. By this exposure, the first electrostatic latent image becomes constituted by two potential levels, more particularly, an image portion potential Vl (exposed area) and non-image portion potential Vd (non-exposed area), as shown in FIG. 2B. The first latent image is developed through a reversal development by a first developing device 4 containing a first color toner electrically charged to a polarity which is the same as the polarity of the latent image (negative). Here, the reversal development is a development wherein toner particles having the same polarity as the polarity of the latent image are deposited on such an area if the photosensitive member where the electric charge has been attenuated.

Through those steps, a first toner image is formed on the photosensitive drum 1. The potential of the toner image portion is at a level Vlt which is higher than the latent image potential Vl by the toner charge ($\Delta$Vt, as shown in FIG. 2C). Here, in FIGS. 2A–2E, the polarity is negative toward upside.

Subsequently, the photosensitive drum 1 still retaining the charge in the area other than the tone image portion, is exposed to positive image light 5 provided by a laser beam 5 modulated in accordance with the second image information so as to attenuate the charge in the non-image area (background area). The intensity of the second laser beam 5 is so selected that the potential Vm at the exposed area is larger than the potential Vlt of the first toner image (absolute value), as shown in FIG. 2D. In other words, the exposed area potential Vm is between the toner image potential Vlt and the non-image area potential Vd in the first exposure. In this manner, the non-exposed area potential Vd constitutes an image area of the second image; the second exposed area potential Vm constitutes a non-image area (background area); they form a second latent image. As a whole of the photosensitive member, a three potential level latent image is formed which is constituted by the second image area having the non-exposed area potential Vd (high potential level), a non-image area (background area) having the second exposed area potential Vm (an intermediate potential level) and a first image area having a first exposed area potential Vl (low potential level), as shown in FIG. 2D.

The second latent image is developed through a regular development by a second developing device 6 containing a second developer having a color different from that of the first toner and charged electrically to a polarity opposite to that of the first toner (positive polarity in this embodiment), as shown in FIG. 2E. Here, the regular development is a development wherein the toner charged to a polarity opposite to that of the latent image is deposited onto such an area of the photosensitive member where the charge is not attenuated.

By selecting the potentials in the manner described above, the electrostatic potential wall (i.e. the first electrostatic latent image) effective to confine the first toner particles to the first image area can be maintained with certainty, and therefore the toner particles constituting the first toner image are prevented from scattering, thus stabilizing those toner particles in the first image area.

In the second exposure, the photosensitive member is exposed to a positive light image. Therefore, the second exposed area (intermediate potential level) corresponds to a background area, whereas the non-exposed area (high potential level) constitutes a second image area. When the second latent image is developed, it is desired that the potential contrast or difference between the intermediate potential level Vm and the high potential level Vd is larger than a certain level, in order that the image portion of the second latent image is developed in a high image density, while no background fog results in the background area. That is, the intermediate potential level Vm preferably satisfies $$|Vd-Vm| \geqq Vc \quad (a)$$

where Vc is a required minimum potential contrast.

As described hereinbefore, the intermediate potential level Vm is set higher (larger in the absolute value) than the first toner image potential. Namely, $$|Vlt| < |Vm| \quad (b)$$

Since, the polarity of the latent image is negative in this embodiment, the following results from the above inequations (a) and (b)

$$Vd-Vc \leqq Vm < Vlt \quad (c)$$

The intermediate potential level Vm is so selected that this is satisfied.

Under those latent image conditions satisfied, the second image area is developed through a regular development by a second developing device containing second color developing toner particles electrically charged to a polarity opposite to that of the latent image. Then, the toner image is produced with a sufficient image density in the second image area and without background fog.

More specific example of this embodiment will be described. The latent image potentials are set as $$Vd = -700\ V;\ Vl = -100\ V.$$

The toner was negatively charged red toner containing as major component styrene-acryl resin material. The potential change ΔVT by the toner charge was 100 V, and therefore the first toner image potential Vlt was −200 V.

In the second development, in order to develop the image portion with a sufficient image density, a potential contrast between the image to be developed and a potential of a bias applied to the second developing device 6 is required to be not less than 250 V; in order to prevent production of foggy background, a potential contrast between the background area and the bias is required to be not less than 20 V; and therefore in combination, the minimum potential contrast Vc between the second image area and the background area is 270 V.

From the above inequation (c), the following results:

$$-430 \leqq Vm < -200 \quad (d)$$

The intensity of the second laser beam 5 was set so as to satisfy the above inequation (d). The second latent image satisfying this was developed by positively charged toner having a second color, for example black toner, through a regular developing operation.

It should be appreciated that the intermediate potential level Vm usable is in a relatively large range, so that even if the intermediate potential level Vm provided by the second exposure easily changes due to the EV property or due to a variation in ambient conditions, the change of the intermediate potential level Vm does not influence the resultant image, by properly setting the potential level (center of the variable range) in consideration of the wide allowable range. Therefore, the foggy background can be stably avoided.

The two color toner images provided through the above process and having two different polarities are subjected to a post charger 7, by which the polarities of the images are made the same. Thereafter, the images are transferred onto the transfer material 9 by a transfer charger 8. The transferred image is fixed by an image fixing device 10, so that a two color print is provided.

The above described image forming process is excellent because it can provide a sharp image. However, the inventors' experiments have revealed that it is further preferable to use a particular developing device as the second developing device to further improve the image quality. More particularly, it has been found that if a so-called magnetic brush developing device is used for developing the second latent image, the first toner image is disturbed by the second developing operation since the magnetic brush brushes the first toner image. The disturbance is sometimes to such an extent that the first toner image is partly scraped off resulting in low image density, or that the scraped toner is mixed into the second developing device, thus deteriorating the color and image quality.

Figure 3:
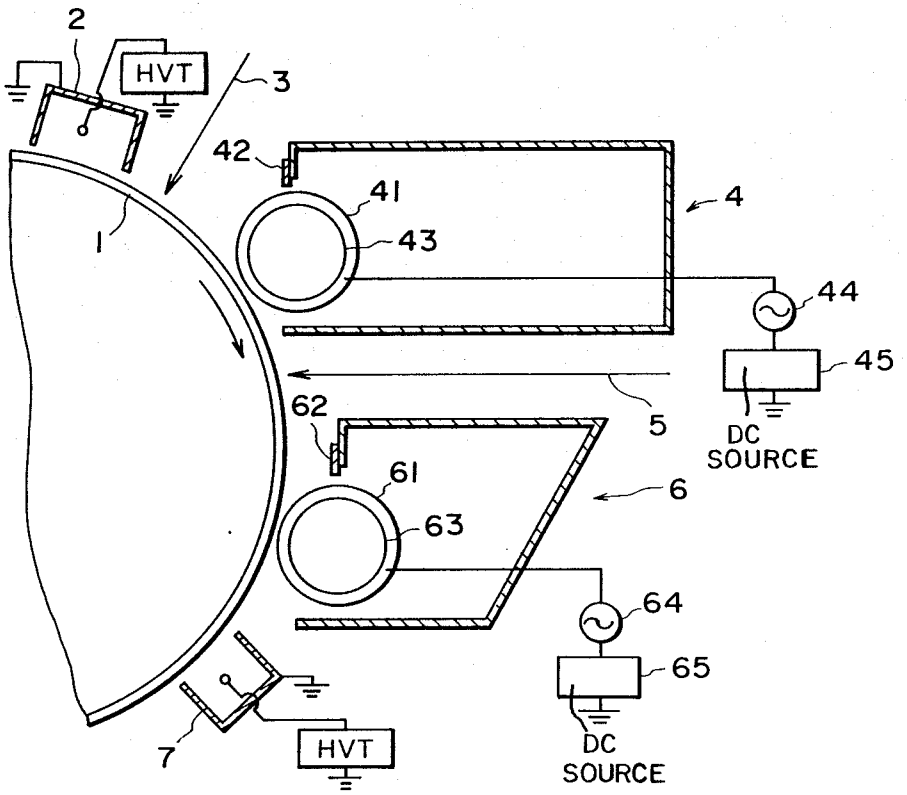
FIG. 3 is a sectional view of a developing apparatus which is suitably used with an electrophotographic according to the present invention.

Referring to FIG. 3, the developing device suitably usable with the electrophotographic apparatus according to this invention will be described.

The first latent image produced by the negative image exposure 3 (first exposure) is developed by the first developing device 4. The first developing device 4 contains therein non-magnetic toner particles and includes a toner carrying member, i.e. a sleeve 41 in this embodiment, enclosing a magnet 43. The nonmagnetic toner has a chromatic color (red, for example) and is charged to the same polarity (negative) as that of the latent image. The non-magnetic toner particles are carried together with magnetic particles on the sleeve 41 toward the photosensitive drum 1 and develops negatively (reversal development) the first latent image. The negative or reversal development is carried out under an alternating electric field provided by a 0 superimposed AC and DC voltages supplied from an alternating voltage source and a DC source 45 connected to the sleeve 41 (developer carrying member). Designated by a reference numeral 42 is a regulating blade for regulating a thickness of a toner layer on 25 the sleeve 41.

Through the development, a first toner image is formed on the photosensitive drum 1 in the chromatic color. The potential of the toner image Vlt is, as described hereinbefore, higher than the latent image potential Vl by the toner charge (ΔVt), as shown in FIG. 2C.

The first developing device using nonmagnetic toner particles and magnetic particles may be in the form as disclosed in Japanese Laid Open Patent Application Publication Nos. 320601980 or 204605/1985 under the name of the assignee of this application.

The second latent image produced by the positive image exposure 5 (the second exposure) is developed by the second developing device 6. The second developing device 6 contains therein one-component magnetic toner particles and includes a developer carrying member, a sleeve 61 in this embodiment for carrying the toner particles and magnet 63 enclosed therein. The one-component magnetic toner particles (the second toner) charged to a polarity (positive) opposite to that of the first toner are formed into a thin toner layer on the sleeve 61 by the regulating blade 62. The toner layer is brought close to the electrostatic latent image bearing member or the photosensitive drum 1, but the layer is out of contact therewith. Across the clearance between the photosensitive drum 1 and the sleeve 61, an alternating electric field is formed provided by a superposed AC and DC voltage supplied from the alternating voltage source 64 and a DC source 65 connected to the sleeve 61. The second latent image is developed by the second toner. The thickness of the toner layer of the second toner particles is 30–500 micron, preferably 30–100 microns; the clearance between the sleeve 61 and the photosensitive drum 1 is 100–600 microns, preferably 200–400 microns, to provide very good quality toner images. In this embodiment, the second toner is black in color.

The bias voltage applied to the sleeve 61 ,by the alternating voltage source 64 and a DC source 65 will be described.

In the second development in this embodiment, the developing conditions are determined so as to develop the second image portion (high potential level Vd) with a sufficient image density, so as to effectively prevent production of fog in the background area (intermediate potential level Vm) and so that the first toner, even if it is mixed into the second toner for one reason or another, is not deposited on the background area (Vm).

In order to satisfy the above-described conditions in this embodiment wherein the polarity of the latent image is negative, the DC component Vdc of 5 the applied bias satisfies, $$Vd < Vdc < Vm \quad (1)$$

Assuming that the potential contrast is required to be not less than Vc2 in order to prevent production of fog by the positively charged second toner in the area of the intermediate potetial level Vm area, the following is satisfied:

$$|Vm - Vdc| \leqq Vc2 \quad (2)$$

Assuming that in order to prevent deposition of the negatively charged first toner mixed into the second toner in the intermediate potential level Vm area, the potential contrast is required to be not more than Vcl, the following is satisfied:

$$|Vm - Vdc| \leqq Vcl \quad (3)$$

From the above, inequations (1), (2) and (3), the DC component Vdc of the bias in the process where the polarity of the latent image is negative as in the present embodiment, the following is satisfied:

$$Vm - Vcl \leqq Vdc \leqq Vm - Vc2 \quad (4)$$

Assuming that the potential contrast required for providing a sufficient image density in the image area is Vco, the following is satisfied:

$$|Vd - Vdc| \leqq Vco \quad (5)$$

Therefore, where the polarity of the latent image is negative, $$Vd + Vco \leqq Vdc \quad (6)$$

Therefore, the DC component Vdc is set to satisfy simultaneously the above inequations (4) and (6).

In the more specific example of this embodiment, the potentials were set as follows:

$$Vd = -700\ V;\ \text{and}\ Vl = -100\ V.$$

The first toner was red toner containing as a major component styrene-acryl resin material. The potential by the toner charge (first development) $\Delta Vt$ was 100 V, and therefore the first toner image potential Vlt was −200 V. From this, the intensity of the laser beam 5 was so selected that the intermediate potential level Vm was smaller than −200 V, for example −250 V.

In this embodiment, the developing device disclosed in Japanese Laid-Open Patent Application Publication No. 18659/1980 was used as the second developing device. And, experiments have revealed that Vcl was 150 V, and Vc2 was 20 V. In consideration of these levels together with the inequation (4), the DC component Vdc was set so as to satisfy:

$$-400 \leqq Vdc \leqq -270 \quad (7)$$

In the above developing device, the potential contrast Vco providing a sufficient image density is not less than 250 V, the following results from inequation (6):

$$-40 \leqq Vdc \quad (8)$$

In this case, the inequation (8) is automatically satisfied if the inequation (7) is satisfied, so that the DC component is set so as to satisfy the inequation (7).

As will be understood from the equation (7), the DC component Vdc is in a relatively wider allowable range, so that even if the intermediate potential level Vm is easily changed by the second exposure due to the or the like, the background without fog can be stably provided by setting the DC component Vdc away from the intermediate level Vm within the range of inequation (7), more particularly, relatively close to −400V so as to reducing the influence by the variation of tee intermediate potential Vm.

In order to tranfer the first toner mixed into the second toner particles onto the photosensitive member, the potential contrast is required not less than Vcl, and therefore, the mixed toner particles are deposited onto the first image portion, in other words, are removed from the second toner particles by setting the potential contrast between the DC component Vdc and the first toner image potential Vlt to be not less than Vcl. More particularly, $$|Vdc - Vlt| \leqq Vcl \quad (9)$$

Similarly, $$Vdc \leqq Vlt - Vcl \quad (10)$$

$$Vdc \leqq -350 \quad (11)$$

From inequations (7) and (10), $$-400 \leqq Vdc \leqq -350 \quad (12)$$

By setting the DC component Vdc so as to satisfy the above inequations, the unique advantage of removing the mixed toner accrues.

In summary, when the latent image polarity is negative, the following is to be satisfied:

$$Vm-Vcl \leqq Vdc \leqq Vm-Vc2 \quad (4)$$

$$Vd+Vco \leqq Vdc \quad (6)$$

$$Vdc \leqq Vlt-Vcl \quad (10)$$

In the case of positive polarity:

$$Vm+Vc2 \leqq Vdc \leqq Vm+Vcl \quad (4)$$

$$Vdc \leqq Vd-Vco \quad (6)$$

$$Vlt+Vc2 \leqq Vdc \quad (10)$$

With those conditions, the above described advantages are provided. The above voltages or potential Vd, Vm, Vl, ΔVt, Vlt, Vco, Vcl and Vc2 are depending on the property of the photosensitive member, developing conditions and developers and are not definitely determined, but may be easily determined by one ordinarily skilled in the art in the light of the above description.

In the system of this embodiment, it is advantageous to reduce the thickness of the toner layer of the second developing device 6. This is because then the mixed toner is more or less exposed at the surface of the layer due to the small thickness of the toner layer, and therefore it is easy to transfer onto the photosensitive drum. However, even if the toner layer is out of contact with the photosensitive drum, the mixed toner is embedded in the thick toner layer if the toner layer is made thick as in the brush development, with the result that it is difficult for the mixed toner to transfer to the photosensitive member. Thus, the amount of the mixed toner is gradually increased.

As regards the alternating bias applied to the second developing device, the frequency was set 1600 Hz, and the voltage was set 1300 Vpp (peak-to-peak voltage). A relatively high frequency, for example, 1000–2000 Hz, has been found preferable since then the toner particles are vibrated to make it easy to separate the mixed toner from the black toner particles. Also, the voltage is preferably set to be relatively high, for example 1000–1800 Vpp since then the reversed electric field effective to jump the mixed toner off the sleeve is strengthened.

The advantage that the first toner mixed into the second toner re-develops the first image without contaminating the background area to remove the first developer from the second developer is provided only in the latent image forming process and/or developing process according to the present invention.

More particularly, since the potential of the latent image in the exposed area by the first image exposure is attenuated substantially down to the residual potential peculiar to the photosensitive member, the contrast after the first development between the toner image potential Vlt and the non-exposed area potential Vd is large. Therefore, in the second image exposure, the amount of the second exposure can be set at a proper level so as to develop the image area with a sufficient image density, assuring a potential contrast between the non-exposed area potential Vd and the background area potential Vm so as not to contaminate the background. Additionally, there can be provided a proper contrast between the first toner image potential Vlt and the intermediate potential Vm so that the first toner mixed into the second toner particles are consumed for re-developing the first image. The second developing device forms a thin layer of the toner, which is opposed to the latent image without contact therewith under an alternating electric field applied across the clearance between the photosensitive member and the developer carrying member. Therefore, the first toner unavoidably mixed into the second toner can be removed by consuming it as re-developing the first toner image, not the second image.

In the foregoing embodiment, the first developer used for the first developing device 4 is a two component developer containing non-magnetic toner particles and magnetic particles. However, this is not limiting, and it may be a one-component developer. The developer layer may be contected to the photosensitive drum or not contacted thereto in the first development.

The second developer used for the second developing device 6 is one-component developer containing magnetic toner particles. However, two component developer may be used. However, the second developer layer is preferably out of contact with the photosensitive drum.

The color of the developers are not limiting, and not limited to the red and black as disclosed herein.

Also, in the foregoing description, the first and second image exposures are executed by a laser beam modulated in accordance with image information. However, a so-called analog type optical system may be usable wherein the photosensitive member is exposed to an analog image corresponding to the original.

As described in the foregoing, according to the present invention, an image of sufficient image density without foggy background can be obtained; and a sharp image can be obtained since the toner particles are not scattered in a line image or in an edge portion of an image. Additionally, a clear two color image ca be provided without mixture of color.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic apparatus, comprising:

a movable electrophotographic photosensitive member;

charging means for uniformly charging said photosensitive member;

first electrostatic latent image forming means for forming a first electrostatic latent image by exposing said photosensitive member charged by said charging means to negative image light corresponding to first image information;

first developing means for developing through a reversal development the first electrostatic latent image into a first visualized image;

second electrostatic latent image forming means for forming a second electrostatic latent image by exposing said photosensitive member having the first visualized image to positive image light corresponding to second image information;

second developing means for developing through a regular development the second electrostatic latent image into a second visualized image;

wherein a potential level in an area of said photosensitive member exposed to the light by said second electrostatic latent image forming means is between a potential level in an area of said photosensitive member exposed to the light by said first electrostatic latent image forming means and a potential level in non-exposed area of said photosensitive member, and is between a potential level of the first visualized image and said level of non-exposed area.

2. An apparatus according to claim 1, wherein an intensity of exposure by said second electrostatic latent image forming means is less than that of said first electrostatic latent image forming means.

3. An apparatus according to claim 1, wherein developer of said first developing means and developer of said second developing means are charged to opposite polarities.

4. An apparatus according to claim 3, further comprising transfer means for transferring the first and second visualized images onto a transfer material from said photosensitive member and charging means for uniformly charging the first and second visualized images, prior to image transfer by said transferring means.

5. An apparatus according to claim 1, wherein the first visualized image and the second visualized images are in different colors.

6. An apparatus according to claim 1, wherein said second developing means includes a developer carrying member for carrying a layer of developer into a developing zone, wherein the developer layer has a thickness less than a clearance formed between said photosensitive member and said developer carrying member.

7. An apparatus according to claim 6, wherein between the developer carrying member of said second developing means and said photosensitive member, an alternating electric field is formed at least during developing operation.

8. An apparatus according to claim 7, wherein the alternating field is provided by applying to said developer carrying member superimposed alternating and DC voltages.

9. An apparatus according to claim 8, wherein the DC voltage component is between the potential level of the exposed area formed by said second latent image forming means and the non-exposed area of said photosensitive member.

10. An apparatus according to claim 6, wherein said second developing means contains one-component developer including toner.

11. An apparatus according to claim 10, wherein the developer is of magnetic property.

12. An apparatus according to claim 1, wherein said first developing means contains two component developer containing magnetic particles and nonmagnetic toner.

13. An apparatus according to claim 12, wherein said first developing means includes a developer carrying member for carrying the developer into a developing zone, where between the developer carrying member and said photosensitive member an alternating electric field is formed at least during developing operation.

14. An apparatus according to claim 13, wherein said alternating electric field is provided by applying to the developer carrying member superimposed alternating and DC voltages.

* * * * *

UNITED STATES PATENT AND TRADEMARK OFFICE

CERTIFICATE OF CORRECTION

PATENT NO. : 4,831,408

DATED : May 16, 1989

INVENTOR(S) : MASAO YOSHIKAWA

It is certified that error appears in the above-identified patent and that said Letters Patent is hereby corrected as shown below:

COLUMN 3

Line 12, "electrophotographic" should read --electrophotographic apparatus--.

COLUMN 4

Line 18, "if" should read --of--.
Line 27, "tone image" should read --toner image--.
Line 28, "5" should be deleted.

COLUMN 5

Line 38, "as" should read --as follows:--.

COLUMN 6

Line 46, "0" should be deleted.
Line 51, "25" should be deleted.
Line 55, "pote-" should read --poten--.
Line 60, "Publication Nos. 320601980" should read --Publication Nos. 32060/1980--.

COLUMN 7

Line 14, "30-500 micron," should read --30-500 microns,--.
Line 33, "5" should be deleted.
Line 43, "$|Vm-Vdc| \leqq Vc2$ (2)" should read --$|Vm-Vdc| \leqq Vc2$ (2)--.

UNITED STATES PATENT AND TRADEMARK OFFICE

CERTIFICATE OF CORRECTION

PATENT NO. : 4,831,408

DATED : May 16, 1989

INVENTOR(S) : MASAO YOSHIKAWA

It is certified that error appears in the above-identified patent and that said Letters Patent is hereby corrected as shown below:

COLUMN 8

Line 38, "the or" should read --the E-V property and the variations in ambient conditions or--.

Line 44, "reducing" should read --reduce-- and "tee" should read --the--.

Line 56, "$|Vdc-Vlt| \leqq Vcl$ (9)" should read --$|Vdc-Vlt| \gtrless Vcl$ (9)--.

Line 63, "$Vdc \leqq -350$ (11)" shuld read --$Vdc \geqq -350V$ (11)--.

COLUMN 10

Line 21, "contected" should read --contacted--.

Line 43, "ca" should read --can--.

Signed and Sealed this

Fifteenth Day of May, 1990

*Attest:*

*Attesting Officer*

HARRY F. MANBECK, JR.

*Commissioner of Patents and Trademarks*